US012312209B2

(12) United States Patent
Beyersdorff et al.

(10) Patent No.: US 12,312,209 B2
(45) Date of Patent: May 27, 2025

(54) WINDING DEVICE

(71) Applicant: ROTZLER HOLDING GMBH + CO. KG, Steinen (DE)

(72) Inventors: Stefan Beyersdorff, Steinen (DE); Juergen Rotzler, Steinen (DE); Thomas Ilchmann, Steinen (DE)

(73) Assignee: ROTZLER HOLDING GMBH + CO. KG, Steinen (DE)

( * ) Notice: Subject to any disclaimer, the term of this patent is extended or adjusted under 35 U.S.C. 154(b) by 276 days.

(21) Appl. No.: 17/930,978

(22) Filed: Sep. 9, 2022

(65) Prior Publication Data

US 2023/0078411 A1 Mar. 16, 2023

(30) Foreign Application Priority Data

Sep. 10, 2021 (EP) ..... 21196141

(51) Int. Cl.
*B65H 75/44* (2006.01)
*B65H 75/14* (2006.01)

(52) U.S. Cl.
CPC ..... *B65H 75/4407* (2013.01); *B65H 75/14* (2013.01); *B65H 75/4481* (2013.01); *B65H 2403/532* (2013.01); *B65H 2701/35* (2013.01)

(58) Field of Classification Search
CPC . B66D 1/36; B66D 1/38; B66D 1/365; B66D 2700/0183; B66D 2700/0191; B65H 54/2848; B65H 54/2827; B65H 54/32; B65H 54/2851; B65H 75/4405; B65H 75/4407; B65H 2403/532
USPC ..... 254/385
See application file for complete search history.

(56) References Cited

U.S. PATENT DOCUMENTS 1,587,998 A * 6/1926 Arthur ..... B65H 54/2851 242/483.9
2,869,797 A * 1/1959 Clerc ..... B65H 54/32 242/477.3
2,972,855 A * 2/1961 Carl ..... B65H 54/2848 242/482.4
3,589,641 A * 6/1971 Lawrence ..... B66D 1/36 242/157.1

(Continued)

FOREIGN PATENT DOCUMENTS

AT 11687 U1 3/2011
DE 1 843 756 U 12/1961

(Continued)

*Primary Examiner* — Emmanuel M Marcelo
*Assistant Examiner* — Henrix Soto
(74) *Attorney, Agent, or Firm* — Walter Ottesen, P.A.

(57) ABSTRACT

A winding device is for winding a rope onto a rope drum rotatable about a rotation axis. The winding device includes a rope guide for feeding the rope to the rope drum. The rope guide has a pivoting arm having a longitudinal axis and has a deflection element. The pivoting arm is pivotable about a pivot axis. The deflection element is disposed on the pivoting arm. The winding device is conceived such that the rope when being wound onto the rope drum passes the pivoting arm before the deflection element. The rope guide includes a delimitation element. The delimitation element is disposed such that a pivoting movement of the pivoting arm about the pivot axis is limited to a critical angular range. The deflection element is tiltable about a tilting axis. The tilting axis extends along the longitudinal axis of the pivoting arm.

17 Claims, 8 Drawing Sheets

(56) References Cited

U.S. PATENT DOCUMENTS

| | | | | | |
|---|---|---|---|---|---|
| 3,809,334 | A * | 5/1974 | Beurer | B64D 1/22 | 242/390.8 |
| 3,951,355 | A * | 4/1976 | Morioka | B65H 54/2851 | 242/478.2 |
| 4,421,284 | A * | 12/1983 | Pan | B65H 54/2851 | 242/481.4 |
| 4,577,810 | A | 3/1986 | Sandvik | | |
| 4,778,121 | A * | 10/1988 | Minnee | B66D 1/38 | 242/157.1 |
| 4,795,108 | A * | 1/1989 | Appling | B65H 75/4405 | 242/157.1 |
| 4,892,262 | A * | 1/1990 | Hurst | B66D 1/38 | 242/157.1 |
| 2004/0021031 | A1* | 2/2004 | Klaus | B65H 54/2848 | 242/397.3 |
| 2004/0069981 | A1* | 4/2004 | Pelletier | E01H 4/02 | 254/385 |
| 2017/0088388 | A1* | 3/2017 | Lillich | B65H 54/2848 | |
| 2017/0210605 | A1* | 7/2017 | Insam | E01H 4/02 | |

FOREIGN PATENT DOCUMENTS

| | | | | | |
|---|---|---|---|---|---|
| DE | 2419406 | A1 * | 11/1975 | B66D 1/38 | |
| DE | 34 07 729 | A1 | 4/1985 | | |
| EP | 1330280 | A * | 6/1963 | | |
| EP | 0 354 320 | A1 | 2/1990 | | |
| EP | 1 125 878 | A2 | 8/2001 | | |
| EP | 1364902 | A2 * | 11/2003 | B65H 54/2827 | |
| FR | 2086707 | A5 * | 12/1971 | | |
| GB | 241797 | A * | 10/1925 | | |
| JP | 07195263 | A * | 8/1995 | B23D 57/0053 | |
| JP | 2003183951 | A * | 7/2003 | B65H 54/2827 | |
| NL | 8200156 | A * | 8/1983 | B66D 1/38 | |
| SE | 1351068 | A1 * | 3/2015 | | |
| WO | 02/14204 | A1 | 2/2002 | | |
| WO | WO-2021105678 | A1 * | 6/2021 | B65H 57/006 | |
| WO | WO-2021149166 | A1 * | 7/2021 | B65H 54/12 | |

* cited by examiner

WINDING DEVICE

CROSS REFERENCE TO RELATED APPLICATION

This application claims priority of European patent application no. 21 196 141.2, filed Sep. 10, 2021, the entire content of which is incorporated herein by reference.

TECHNICAL FIELD

The disclosure relates to a winding device for winding and unwinding a rope.

BACKGROUND

When winding a rope on a rope drum it is the intention that the individual rope windings lie directly and firmly next to one another so that a positive winding pattern results. To this end, the rope, when being wound onto the rope drum, per revolution of the rope drum has to be offset in the axial direction of the rope drum by approximately the diameter of the rope. This offset of the rope in the axial direction of the rope drum is also referred to as rope pitch.

It is known that a positive winding pattern results when the run-up angle of the rope, which is measured in relation to a plane perpendicular to the rotation axis of the rope drum, is not substantially more than 3°. The run-up angle is measured in a tangential plane to the rope already wound on the rope drum, at the point where the rope runs onto the already wound tiers of the rope.

The tangential plane is disposed at a spacing from the rotation axis, the spacing corresponding to the mean radius of the outermost wound rope tier. This so-called "+/−3° winding principle" utilizes a rope winding method in which the rope running-up is guided to the rope drum by way of a fixed rope pole. The rope pole in the direction perpendicular to the rotation axis of the rope drum is so far away that the run-up angle on the flange disc of the rope drum can be at most 3°. The rope pole typically lies in the centre between the flange discs of the rope drum. In order for the run-up angle not to substantially exceed 3°, the spacing of the rope pole from the rotation axis of the rope drum is at least 9.5 times the mutual spacing of the flange discs of the rope drum, measured in the direction of the rotation axis of the rope drum. In such an arrangement it is guaranteed that the windings of the rope running-up are placed next to one another without further guidance. The axial winding direction is reversed in a self-acting manner when the rope impacts the flange disc. In order to prevent that the rope, instead of running in the other axial winding direction, is wound in a plurality of windings on top of one another on the flange disc, the so-called winding angle must not be excessively small. The winding angle corresponds to the run-up angle of the rope onto the rope drum once the rope has reached the flange disc. In the case of a winding angle of 3° the rope running-up to the flange disc is drawn away from the flange disc again. A positive winding pattern results in this arrangement. However, the large installation space required by such a winding device is disadvantageous.

Likewise known is the use of a winding arm or pivoting arm for winding a rope. A winding arm is mounted so as to be freely pivotable about a pivot axis. The pivot axis is typically disposed in the centre of the rope drum so as to be in a plane perpendicular to the rotation axis of the rope drum. The pivot axis can be disposed much closer to the rope drum than the rope pole in the "+/−3° winding principle", this being the reason for this winding device requiring less installation space. The rope running-up is guided along the winding arm to the rope drum. The winding arm, on the end thereof that faces the rope drum, has a deflection roller. From the deflection roller, the rope runs onto the rope drum at a small angle. To this end, the rope is typically deflected by approximately 90° on the deflection roller. As a result, the rope in the run-up region runs onto the rope drum so as to be approximately parallel to the pivot axis of the winding arm. In this winding device, the run-up angle of the rope onto the rope drum is determined not only by the pivoted position of the pivoting arm but also by the position of the deflection element in relation to the rope drum. The position of the deflection element is defined by the radial spacing of the deflection element from the rotation axis of the rope drum and by the axial spacing of the deflection element from a central plane of the rope drum, measured in the direction of the rotation axis of the rope drum. The central plane is oriented so as to be perpendicular to the rotation axis of the rope drum and disposed in the centre between the two flange discs of the rope drum. The run-up angle is measured in a tangential plane to the rope already wound on the rope drum, at the point where the rope runs onto the already wound tiers of the rope, in relation to a plane perpendicular to the rotation axis of the rope drum. The tangential plane is disposed at a spacing from the rotation axis, the spacing corresponding to the mean radius of the outermost wound rope tier.

A winding device having a winding arm is typically disposed such that the run-up angle of the rope in the case of a deflection of the rope on the deflection roller by 90° is approximately 0°. In the case of a rope of which half has been wound, this usually applies when the winding arm is positioned in the centre between the two flange discs. By virtue of the pivoting movement of the winding arm about the pivot axis, the deflection roller moves in an orbit relative to the pivot axis. When the winding arm is swivelled from the central position, in which the deflection of the rope on the deflection element is approximately 90°, the deflection angle of the rope on the deflection element changes. The arrangement is typically conceived such that the deflection angle decreases as the winding arm is pivoted from the central position. The run-up angle of the rope onto the rope drum increases as the winding arm is pivoted from the central position. By virtue of the positioning of the deflection roller, which is disposed on the free longitudinal end of the winding arm, relative to the rope drum, and by virtue of the deflection of the rope on the deflection roller, the run-up angle can also be kept below 3° in this arrangement, despite the spacing of the pivot axis from the rotation axis of the rope drum being smaller than the spacing of the rope pole in a winding device having a fixed rope pole. The winding angle in this arrangement can be greater than or equal to 3°. The winding angle is the run-up angle of the rope when the latter impacts the flange disc. The winding angle ideally is 3°. The winding device having a winding arm has a travelling rope pole, specifically the deflection element.

Such a winding arm can be used only for winding one rope onto one storage drum. The majority of the force caused by a load suspended on the rope or by a tensile force acting on the rope here is absorbed by a winch disposed between the load and the storage drum. As opposed to a storage drum which always has a more or less constant pretension force, the latter being far below the tensile force of the winch, a rope drum which is configured as part of the winch is stressed by the maximum tensile force, because the rope drum is an integral major component part of the winch per se. The forces in the rope fluctuate between zero and the maximum tensile force of the winch. A winding device having a winding arm still has an inadequately compact configuration, despite the respective improvement in comparison to the +/−3° winding principle with a fixed pole.

There are further winding devices such as, for example, systems that are displaceable in parallel and reversing systems that are either driven by the rope drum by way of a cross spindle or are provided with an external drive and a controller. They all have the same function in terms of the orderly depositing of the rope on the rope drum, specifically of placing one winding directly beside the next such that the rope formation is firm and without gaps, and of directing the rope in an orderly manner away from the flange disc and in the opposite direction when a change of tiers takes place.

SUMMARY

It is an object of the disclosure to provide a winding device which delivers a positive winding pattern while requiring a small installation space.

This object can, for example, be achieved by a winding device for winding a rope onto a rope drum which is rotatable about a rotation axis. The winding device includes: a rope guide for feeding the rope to the rope drum; the rope guide having a pivoting arm defining a longitudinal axis and further having a deflection element; the pivoting arm being pivotable about a pivot axis; the deflection element being disposed on the pivoting arm; wherein the winding device is configured such that the rope when being wound onto the rope drum passes the pivoting arm before the deflection element; the rope guide including a delimitation element disposed such that a pivoting movement of the pivoting arm about the pivot axis is limited to a critical angular range Δ; and, the deflection element being tiltable about a tilting axis extending along the longitudinal axis of the pivoting arm.

Proceeding from the known winding arm, the desired compactness and load-bearing capability can be achieved in a cost-effective manner by modifications. The disclosure therefore proceeds from a winding device having a winding arm.

The disclosure is based on the concept that it is difficult or almost impossible for the run-up angle of the rope onto the cable drum in a compact winding device having a pivoting arm, the latter being short owing to the desired compactness, to be kept at 3° across the entire width of the rope drum. Owing to the required compactness, the pivoting angle of the pivoting arm has to be very large in order for the deflection element to be able to be guided sufficiently close to the flange disc. It is only then that the reversal movement of the rope on a drum of the rope drum is to take place in an orderly manner when a change of tiers takes place.

In order to make available guiding of the rope that enables a run-up angle and a winding angle of 3° independently of the length of the pivoting arm, or of the length of the pivotable part of the rope guide, respectively, relative to the pivot axis, the deflection element is mounted so as to be tiltable about a tilting axis which extends along the longitudinal axis of the pivoting arm. The tilting axis extends in particular so as to be centric in relation to the rope. As a result of the tilting capability of the deflection element, a run-up angle of the rope onto the rope drum of less than 3° is possible in a large angular range even with a comparatively minor length of the pivoting arm. As a result, it is possible for a winding angle of approximately 3° to be achieved even with a minor length of the pivoting arm. As a result, it is in particular possible for a winding angle of 2° to 4°, expediently of 2.5° to 3.5°, in particular of 2.8° to 3.2°, preferably of 2.9° to 3.1°, to be achieved even with a minor length of the pivoting arm. As a result of the tiltable configuration of the deflection element, the winding device can be of a compact configuration and nevertheless wind the rope onto the rope drum so as to provide a positive winding pattern. The winding device according to the disclosure occupies only a small installation space and nevertheless delivers a positive winding pattern. The pivoting angle of the pivoting arm can be limited by virtue of the tiltable deflection element. By virtue of the tiltable deflection element a rope exit opening of the rope from the deflection element can be brought closer to the flange disc even in the case of a fixedly held pivoting arm. A small run-up angle is achieved herein. A small winding angle is achieved herein.

It is provided that the rope guide includes a delimitation element which is disposed such that a pivoting movement of the pivoting arm about the pivot axis is limited to a critical angular range. The critical angular range is in particular a contiguous angular range. The critical angular range expediently is at most 135°, in particular at most 90°, preferably at most 70°, particularly preferably at most 60°.

The drum of the rope drum has a radius. The spacing from the pivot axis to the rotation axis of the rope drum is expediently more than the radius of the drum of the rope drum. The spacing of the pivot axis from the rotation axis of the rope drum is in particular less than twice, preferably less than 1.5 times, the radius of the drum of the rope drum.

The delimitation element is in particular a component part of the winding device and configured independently of the rope drum. By virtue of the tilting capability of the deflection element, the deflection element can continue to follow the rope running-up onto the rope drum even when the pivoting arm bears on the delimitation element. As a result of the smaller pivoting angle by virtue of the delimitation element, and by virtue of the tilting capability of the deflection element, a positive winding pattern can be achieved even with a compact construction mode of the pivoting arm. Despite a shorter length of the winding arm, or of the pivotable part of the winding device, respectively, a winding angle of approximately 3° can in particular be achieved. Despite the minor length of the winding arm, or of the pivotable part of the winding device, respectively, the run-up angle of the rope can be less than 3°.

The winding device is in particular suitable for winding and unwinding, and for a multi-tier rope formation. The winding device is in particular suitable for draw winches as well as hoisting winches, which have to meet higher safety standards. The winding device is expediently conceived for drawing applications using forces of 10 kN to 1000 kN, in particular of 50 kN to 500 kN. The winding device is expediently conceived for hoisting applications using forces of 1 kN to 100 kN, in particular of 10 kN to 50 kN.

The pivoting arm expediently has a rope window. A rope can run through the rope window. The rope during winding is fed to the pivoting arm by way of the rope window. The pivoting arm is in particular conceived such that the rope is guided from the rope window along the pivoting arm to the deflection element.

By virtue of the delimitation element and the delimitation of the pivoting range of the pivoting arm associated therewith, the magnitude of the deflection of the rope is limited when the rope enters by way of the rope window. As a result, the rope is guided with little wear and tear. The durability of the rope is high.

The combination of a tiltable deflection element and a delimitation element enables in particular a compact construction mode of the winding device while at the same time providing a positive winding pattern. As a result, the winding device can be conceived such that the rope, by virtue of the tiltable deflection element, by the rope guide can be guided into a region of the rope drum outside the critical angular range, even when the pivoting arm is positioned at the periphery of the critical angular range. A collision between the pivotable part of the winding device and one of the two flange discs or the rope formation can be avoided in the process. The part of the rope that is wound onto the drum of the rope drum, in particular wound thereon in multiple tiers, is referred to as the rope formation.

In an analogous manner, unwinding of the rope from the rope drum is possible using the winding device according to the disclosure. The compactness of the winding device according to the disclosure, enabled by the delimitation element and the tilting capability of the deflection element, is also advantageous for this specific application.

The winding device can advantageously be conceived such that the deflection element is tiltable about the tilting axis such that the rope is able to be guided by the deflection element in an angular range outside the critical angular range. As a result thereof, an arm length of the pivoting arm, measured perpendicularly to the pivot axis, can be small, and a positive winding pattern can nevertheless be achieved. The pivotable part of the rope guide has a pivoting length which, proceeding from the pivot axis, is measured perpendicularly to the pivot axis. As a result of the guide being able to be guided by the tiltable deflection element in the angular range outside the critical angular range, the pivoting length can be small, and a positive winding pattern can nevertheless be achieved.

The deflection element in terms of the tilting axis is in particular disposed in a tilted position. The pivoting arm in terms of the pivot axis is disposed in a pivoted position. The deflection element is in particular freely tiltable about the tilting axis in each pivoted position of the pivoting arm. In an embodiment of the disclosure, it is provided that the winding device includes an actuator, and that the actuator predefines the tilted position as a function of the pivoted position. As a result, the winding device can be configured such that the rope is wound onto the winding drum by way of a continuous advancing motion acting in the direction of the rotation axis of the rope drum. As a result, the winding device can be configured such that the rope, independently of guiding provided by a pretensioned rope, is wound onto the rope drum by way of a continuous advancing motion acting in the direction of the rotation axis. The advancing motion in the direction of the rotation axis of the rope drum in this instance is uniform and continuous, independently of the pretensioning and guiding by the rope. In particular, the rope in the critical angular range can be wound by way of a predefined run-up angle. The winding device as a result of the actuator can be configured such that a positive winding pattern results independently of any force acting on the rope, for example as a result of a load. The winding device can thus be configured such that a positive winding pattern results even in the case of variations in the size of the load. The greater the load/force in the rope, the more positive the winding pattern. The force acting on the rope is ideally 2% of the minimum breaking force of the rope.

It can be provided that, in a peripheral position of the pivoting arm on the periphery of the critical angular range, a plurality of different tilted positions of the deflection element are possible in the same pivoted position of the pivoting arm. The deflection element advantageously runs freely in the peripheral positions of the critical angular range. The deflection element runs freely in particular in each pivoted position of the pivoting arm.

The deflection element is in particular positively controlled in the critical angular range. It can be provided that the deflection element is positively controlled in each pivoted position of the pivoting arm. The winding device is in particular conceived such that a largest tilting angle of the deflection element is present in the peripheral position of the pivoting arm. The winding device can advantageously be conceived such that a stepless transition in terms of the tilted position of the deflection element takes place when pivoting the pivoting arm between a smallest and the largest tilting angle.

In an embodiment of the disclosure the rope guide has a pivot gear. The winding device is in particular conceived such that the pivoting arm via the pivot gear is movable in a reciprocating manner in the critical angular range. The winding device has in particular a pivot drive. The pivot gear is expediently a component part of the pivot drive. The pivot drive can advantageously be a returning pivot drive.

The pivot gear includes in particular a crank mechanism. The pivot gear expediently has a shaft which is rotatable about a shaft axis, a pin which is disposed eccentrically to the shaft axis and via the shaft is movable about the shaft axis, and a connecting rod. The connecting rod connects in particular the pin to the pivoting arm. The connecting rod is expediently rotatably mounted on the pin.

The pivot gear, in particular the crank mechanism, can preferably be conceived such that the spacing between the shaft axis and the pin varies in the movement of the pin about the shaft axis. As a result, any unevenness which would otherwise arise by virtue of the disposal of the connecting rod when the pin is guided on an orbit can be compensated for. The spacing between the shaft axis and the pin in the movement of the pin about the shaft axis is expediently varied such that a constant advancing motion results when the rope is being wound on the rope drum. The spacing between the shaft axis and the pin in the movement of the pin about the shaft axis is in particular varied such that a constant rope pitch is achieved when winding the rope on the rope drum. The offset of the rope in the direction of the rotation axis of the rope drum is referred to as the rope pitch. The winding device is in particular conceived such that the pivoting arm in a revolution of the rope drum about the rotation axis is offset in the direction of the rotation axis of the rope drum by 100% to 110% of the rope diameter of the rope, in particular by 100% to 105% of the rope diameter of the rope, preferably by 100% to 102% of the rope diameter of the rope.

The pivot gear expediently has a cam with a track in which the pin is guided on the path of the latter about the shaft axis. The cam is in particular stationary in relation to a rotating disc of the pivot gear. The rotating disc is expediently rotatable about the shaft axis via the pivot gear. The rotating disc in particular has an elongate bore which completely penetrates the rotating disc in the direction of the shaft axis and extends along the radial direction of the shaft axis. The pin is in particular extended through the elongate bore of the rotating disc and through the track of the cam disc. The crank radius and thus the movement of the pivoting arm can be linearized as a result. As a result, the movement in the direction of the rotation axis by a longitudinal end of the pivoting arm that faces the deflection element can take place at a constant speed. It can also be provided that the speed of the longitudinal end of the pivoting arm in the direction of the rotation axis is proportional to the rotating speed of the rope drum.

In an embodiment of the disclosure the deflection element includes a plurality of rollers. The plurality of rollers are in particular disposed next to one another on a cam track. A compact deflection of the rope is possible as a result. The rope here is exposed to only a minor mechanical stress. The wrapping angle of the rope about each one of the plurality of rollers is in particular at most 25°, expediently at most 15°, advantageously at most 10°, preferably at most 5°. As a result of the plurality of rollers being disposed on the cam track, the diameter of the individual rollers can be very small and an exit opening of the deflection element for the rope can be guided closer to the circumferential face of the rope drum. The exit opening of the deflection element can be guided close to the rope formation. The disposal of the plurality of rollers on the cam track enables improved feeding of the rope to the rope drum. This results in a positive winding pattern.

In the case of a single roller as a deflection element the wrapping angle for the individual roller would be very much larger than for a single one of the plurality of rollers of the deflection element according to the refined disclosure. In order to keep the stress of the rope low, the diameter of the individual roller would have to be very much larger, which would have the consequence that the rope could not be guided that close to the rope drum because the vacant side of the single roller, by virtue of the large diameter of the single roller, would protrude in the direction of the rope drum. Since the diameter of the single roller would be multiple times larger than the diameter of a single roller of the plurality of rollers of the deflection element, a larger spacing from the rope drum would be required for the single roller than for the deflection element. The winding device can be of a compact construction as a result of the plurality of rollers.

The cam track can advantageously have an elliptic profile. The elliptic profile is present viewed perpendicularly onto a deflection plane. As a result, the contact forces of the individual rollers can be configured so as to be uniform.

In an embodiment of the disclosure, the winding device is a component part of a rope take-up winding device. The rope take-up winding device includes the rope drum and the winding device. The rope drum has in particular two flange discs. The rope take-up winding device is expediently conceived such that the pivoting arm is pivotable about the pivot axis in a reciprocating manner between the two flange discs.

The winding device is in particular conceived such that the critical angular range limits the pivoting movement of the pivoting arm to a range in which it is avoided that the part of the rope guide that is pivotable about the pivot axis contacts a flange disc of the rope drum, or an imaginary plane of the flange disc, respectively. The flange disc is also referred to as a flange wall. By being limited to the critical angular range, a collision between the pivotable part of the rope guide and the flange disc or the rope formation can be avoided. In the absence of the delimitation element, that part of the rope guide that is pivotable about the pivot axis between the flange discs would be pivotable in a maximum flange angular range between the two flange discs, in particular between the planes assigned to the flange discs. That part of the winding device that is pivotable about the pivot axis could collide in particular with the flange discs or the rope formation. The critical angular range is expediently at most 80% of the maximum flange angular range. The critical angular range is in particular at most 75% of the maximum flange angular range. The critical angular range is preferably at most 70% of the maximum flange angular range. The critical angular range in terms of the direction of the rotation axis of the rope drum is in particular disposed so as to be symmetrical between the two flange discs. However, it may also be provided that the critical angular range is disposed asymmetrically in terms of a central plane that in the centre between the two flange discs runs perpendicularly to the rotation axis. The position of the critical angular range can be chosen with a view to an optimum winding angle.

Each flange disc has a diameter measured perpendicularly to the rotation axis. The largest one of these diameters is referred to as the maximum diameter. The pivoting length can advantageously be at most 100% of the maximum diameter. The pivoting length is in particular at most 95% of the maximum diameter. The pivoting length is preferably at most 90% of the maximum diameter. As a result, the winding device can be of a compact construction. The winding device occupies only a minor installation space. As a result of the minor pivoting length, only a minor torque acts by way of the rope on the pivotable part of the rope guide. In particular, the leverage acting on the pivotable part of the winding device is small by virtue of the minor pivoting length. A winding device having a pivoting length of at most 100% of the maximum diameter can wind a rope with a large force acting on the latter, for example by virtue of a load suspended on the rope.

The rope take-up winding device advantageously can have a drum drive for driving the rope drum. As a result, the rope can be wound onto the rope drum in a simple manner. As a result, the rope can be wound onto the rope drum by way of a controlled power output. In particular, the rope by way of one end thereof is fastened to the rope drum. The rope is in particular a component part of the rope take-up winding device. The rope drum can advantageously be configured as a component part of a storage drum.

The rope take-up winding device can advantageously be conceived such that the rope guide, in particular the pivoting arm of the rope guide, at a specific rotary position of the rope drum in terms of the rotation axis, as a function of the rotary position assumes a pivoted position. It can thus be provided that the pivoting arm is positively controlled.

The rope take-up winding device expediently has a drum drive for driving the rope drum, in particular the drum of the rope drum. The drum drive is in particular a component part of the pivot drive, of which the pivot gear is a component part. The drum drive and the pivot drive can preferably utilize a common motor. The pivot drive and the drum drive are in particular mutually adapted. The motor can advantageously drive the rope drum, configured as a component part of the storage drum, and the pivot gear in series. The motor drives the drum of the storage drum by way of a separate gearbox, and the pivot gear is suspended on the drum of the storage drum.

The winding device can advantageously be driven by way of the rope drum, configured as a component part of the storage drum, and by the pivot gear driven by way of the rope drum. The gearing of the pivot gear is in particular twice the number of rope windings of one rope tier of the rope drum. The number of rope windings is identical on each rope tier. The total gearing ratio of the pivot gear is advantageously approximately 20 to 50. The gearing of the pivot gear is in particular implemented by a chain mechanism and a worm mechanism. The chain mechanism is expediently suspended on the rope drum and drives the worm mechanism. The shaft that is connected to the pivoting arm by way of a connecting rod can advantageously be situated on the worm mechanism. The shaft is a component part of the crank mechanism.

The pivot drive is in particular a pivot drive that returns after two tiers, and upon sweeping (in a reciprocating manner) the pivoting angle in both directions of the rotation axis of the rope drum returns to the initial position of the pivot drive. The worm mechanism expediently has a fixed gearing, and the number of windings is set by way of the chain mechanism. The chain mechanism has in particular a gearing of approximately 2.5.

The rope drum is in particular a component part of a drum winch. All the tensile forces from the rope are transmitted to a rope drum as a component part of a drum winch.

However, it can also be provided that the rope drum is a component part of a storage drum. Only pretension forces from the rope are transmitted to a rope drum as a component part of a storage drum.

BRIEF DESCRIPTION OF THE DRAWINGS

The invention will now be described with reference to the drawings wherein.

DESCRIPTION OF THE PREFERRED EMBODIMENTS

Figure 1:
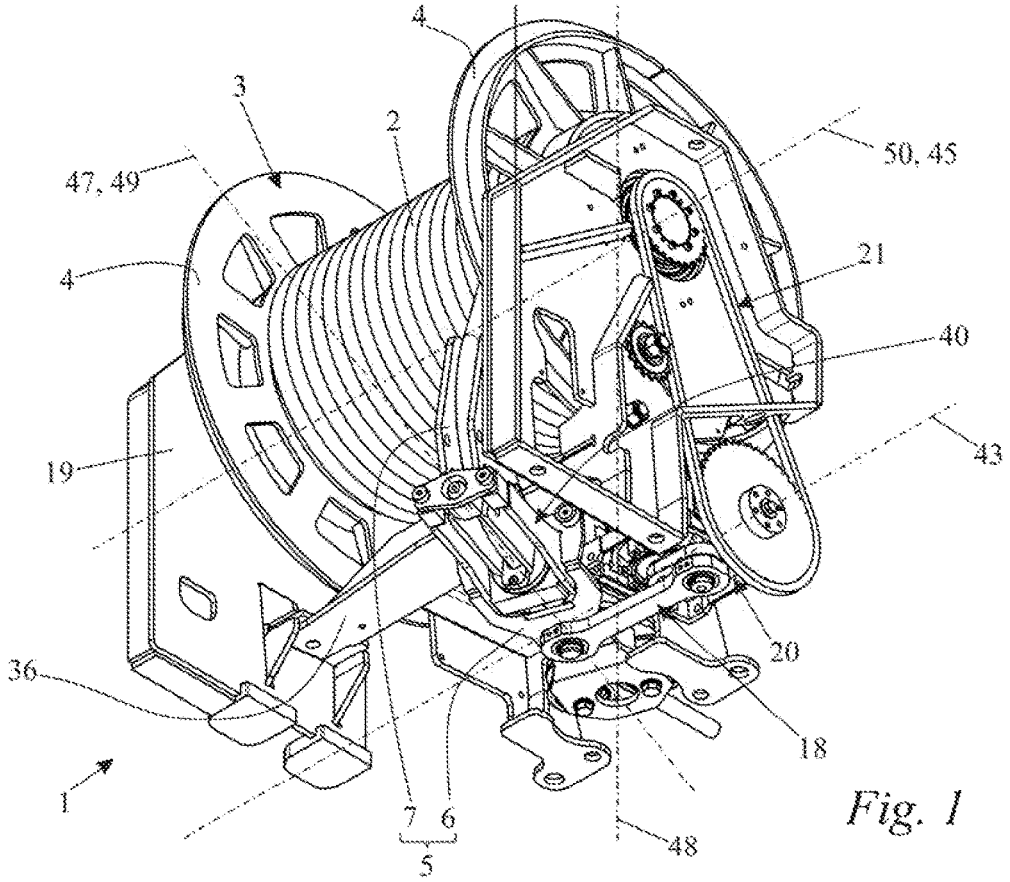
FIG. 1 shows a perspective illustration of a winding device.

FIG. 1 shows a rope take-up winding device 1. The rope take-up winding device 1 includes a winding device 40 and a rope drum 3 having a rope 2. The winding device 40 serves for winding the rope 2 onto the rope drum 3. To this end, the rope drum 3 is mounted so as to be rotatable about a rotation axis 50. The winding device 40 serves for unwinding the rope 2 from the rope drum 3.

The rope take-up winding device 1 is suitable for the multi-tier operation. The winding device 40 is suitable for hoisting winches and draw winches. The winding device 40 is conceived for drawing applications using forces of 10 kN to 1000 kN, in the embodiments of 50 kN to 500 kN. The winding device 40 is conceived for hoisting applications using forces of 1 kN to 100 kN, in the embodiments of 10 kN to 50 kN.

The rope take-up winding device 1 includes a main body 19. The main body 19 is a component part of the rope drum 3. The drum of the rope drum 3 is rotatably mounted on the main body 19. The main body 19 is also referred to as a support bearing.

The rope drum 3 includes the drum, the two flange discs 4 and the main body 19. The drum has a drum shell. The drum shell extends between the two flange discs 4. The drum shell encircles the rotation axis 50. The drum shell has the shape of the circumferential face of a cylinder.

The rope take-up winding device 1 has a drum drive. The drum drive serves for driving the rope drum 3 so as to perform a rotating movement about the rotation axis 50. The drum drive in the embodiments includes a motor, not illustrated, having a motor rotation axis 45. The drum drive includes a gearbox (not illustrated). The gearbox is disposed between the motor and the rope drum 3. It can also be provided that the drum drive does not have any such gearbox. The motor rotation axis 45 in the embodiments runs so as to be coaxial with the rotation axis 50 of the rope drum 3. The motor drives the rope drum 3.

The rope 2 by way of one end is fastened to the rope drum 3. The rope drum 3 has two flange discs 4 illustrated in FIG. 1. The flange discs 4 limit a winding space for the rope 2 in the direction of the rotation axis 50. The winding space in the direction radial to the rotation axis 50 is limited by the drum of the rope drum 3. The rope 2 can be wound onto a drum of the rope drum 3 between the flange discs 4. The rope take-up winding device 1 is conceived such that the rope 2 is wound on the rope drum 3 such that, upon winding, in terms of the direction of the rotation axis 50, one winding is initially placed next to another winding onto the rope drum 3 until the rope 2 impacts a flange disc 4. When the rope 2 impacts the flange disc 4, the rope runs onto the rope drum 3 at a winding angle $\alpha$ illustrated in FIG. 5. The winding angle $\alpha$ is measured in a tangential plane to the rope 2 already wound on the rope drum 3, at the point where the rope 2 runs onto the already wound tiers of the rope 2, in relation to a plane G. The tangential plane is disposed at a spacing in relation to the rotation axis 50, which corresponds to the mean radius of the outermost wound rope tier. The tangential plane in FIG. 5 runs so as to be parallel to the drawing plane. Each flange disc 4 is disposed in a plane G. The plane G runs perpendicularly to the rotation axis 50. The plane G bears on the inside of the flange disc 4. The insides of the flange discs 4 face one another. The inside of the flange disc 4 limits the receptacle space of the rope drum 3 for the rope 2.

Once the rope 2 has impacted the flange disc 4, the axial winding direction of the rope 2 changes. The rope 2 is now wound from the flange disc 4, impacted by the rope 2, away towards the opposite flange disc 4. A new rope tier in terms of the direction radial to the rotation axis 50 is created in the process. A tidy winding pattern results in this way.

The rope drum 3 in the embodiments is a component part of a storage drum. The storage drum includes the drum drive. The storage drum includes a controller, not illustrated. The storage drum includes the rope guide 5. A rope winch, not illustrated, is disposed upstream of the rope drum 3. Only pretension forces from the rope 2 are transmitted to the storage drum. However, it can also be provided that the rope drum is a component part of a drum winch. The drum winch includes the drum drive. The drum winch includes a controller. In an embodiment of the rope drum as a component part of a drum winch, all the forces that act on the rope 2 are transmitted from the rope 2 to the rope drum.

The winding device 40 in the embodiments includes a rope guide 5 (FIG. 1). The rope 2 is fed to the rope drum 3 by way of the rope guide 5. The rope guide 5 includes a pivoting arm 6 and a deflection element 7. The pivoting arm 6 is pivotable about a pivot axis 48. The pivot axis 48 lies in a plane which is oriented perpendicularly to the rotation axis 50 and is disposed between the two flange discs 4, in particular in the centre between the two flange discs 4. The direction of the pivot axis 48 runs perpendicularly to the direction of the rotation axis 50. The pivot axis 48 runs parallel to a tangent that bears on the rope drum 3. The pivot axis 48 can be disposed at a spacing from the drum of the rope drum 3. The pivoting arm 6 is pivotable about the pivot axis 48, in a reciprocating manner between the two flange discs 4. The two flange discs 4 lie in each case in one of the two planes G. The plane G is oriented so as to be perpendicular to the rotation axis 50. The two planes G limit in each case the flange discs 4 to the insides of the flange discs 4 that face one another in terms of the rotation axis 50. The pivoting arm 6 is pivotable in a reciprocating manner between these two planes G of the flange discs 4. The pivoting arm 6 can be positioned in relation to the rope drum 3 such that the pivotable part of the rope guide 5 is arranged partially or, as in the embodiments, completely radially in terms of the rotation axis 50 outside the flange discs 4.

Figure 2:
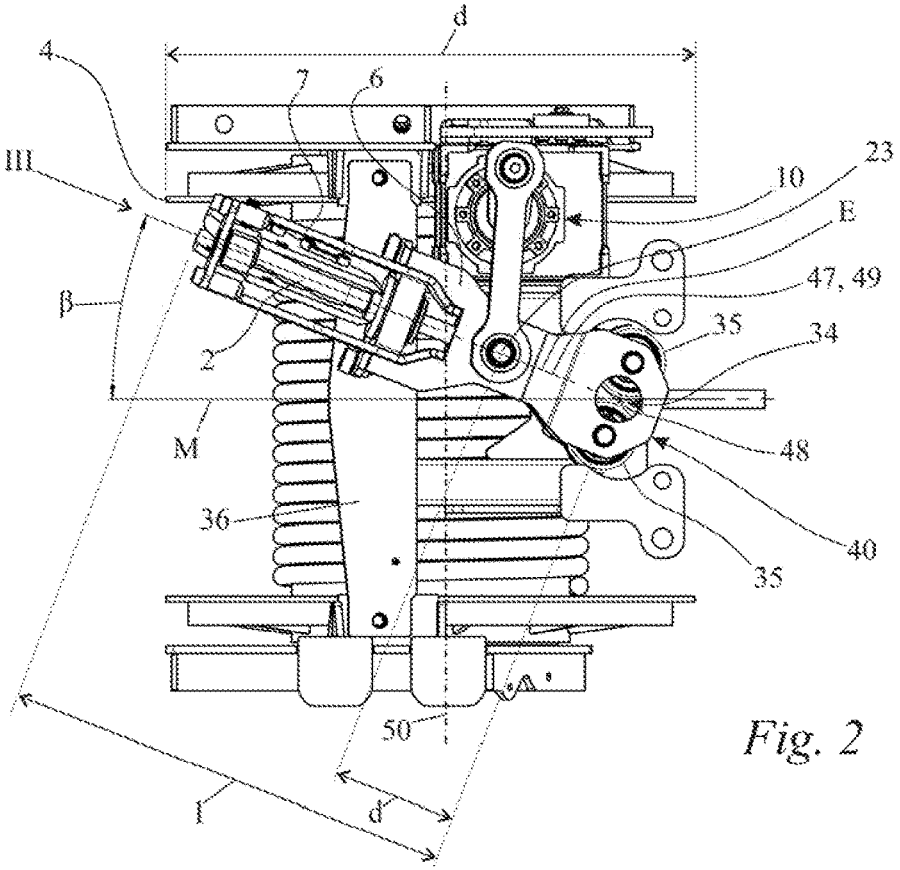
FIG. 2 shows a plan view from below onto the winding device from FIG. 1.

The pivoting arm 6 has a rope window 34 (FIG. 2). The rope 2 is fed to the pivoting arm 6 through the rope window 34 on the longitudinal end of the pivoting arm 6 that faces away from the deflection element 7. Between the rope window 34 and the deflection element 7, the rope 2 is guided along the longitudinal axis 49 of the pivoting arm 6. The rope window 34 includes two guide rollers 35. The guide rollers 35 are mounted so as to be rotatable on the pivoting arm 6. The guide rollers 35 are rotatable about roller axes. The roller axes run so as to be parallel to the pivot axis 48 of the pivoting arm 6. The guide rollers 35 are disposed so as to lie next to one another. The guide rollers 35 limit the rope window 34 on mutually opposite sides of the rope window 34. The rope 2 runs between the two guide rollers 35. The rope 2 bears on both guide rollers 35. The rope 2 is deflected by the guide rollers 35.

The winding device 40 includes a support element 36 illustrated in FIG. 1 or 2. The support element 36 serves for supporting the pivotable part of the rope guide 5. The support element 36 serves for supporting the pivoting arm 6. The support element 36 is disposed such that the support element 36 supports the pivoting arm 6 on the longitudinal end thereof that faces away from the pivot axis 48. The support element 36 in the direction radial to the rotation axis 50 is disposed between the pivoting arm 6 and the rope drum 3. The support element 36 by way of the longitudinal extent thereof extends in the direction of the rotation axis 50. The support element extends from one flange disc 4 to the other flange disc 4 of the rope drum 3. In the reciprocating movement of the pivoting arm 6, the leverage forces generated by the rotating movement of the rope drum 3 and transmitted via the rope 2 to the pivoting arm 6 by way of the deflection element 7 are at least partially absorbed by the support element 36. The support element 36 in the embodiments is a rail. The support element 36 is fastened to a frame 33 of the winding device 40. The frame 33 of the winding device 40 in the embodiments is formed by the main body 19 of the rope drum 3. However, a winding device having a frame configured separately from the rope drum can also be provided. An embodiment of a winding device without a support element can also be provided.

The deflection element 7 is disposed on the pivoting arm 6. The deflection element 7 is disposed on that end of the pivoting arm 6 that faces away from the pivot axis 48. The deflection element 7 is disposed such that the rope 2, when being wound onto the rope drum 3, passes the pivoting arm 6 before the deflection element 7. The deflection element 7 is disposed functionally between the pivoting arm 6 and the rope drum 3. The winding device 40 is conceived such that the rope 2 is guided along the pivoting arm 6. The rope 2 is guided from the pivot axis 48 up to a longitudinal end of the pivoting arm 6 that faces the deflection element 7. The rope 2 is guided from the rope window 34 to the deflection element 7 along the pivoting arm 6.

The deflection element 7 is tiltable about a tilting axis 47. The pivoting arm 6 has a longitudinal axis 49. The tilting axis 47 extends along the longitudinal axis 49 of the pivoting arm 6. The tilting axis 47 runs transversely, in the embodiment perpendicularly, to the pivot axis 48. The tilting axis 47 runs radially to the pivot axis 48. The tilting axis 47 is pivotable about the pivot axis 48.

Upon passing the pivoting arm 6, the rope 2 is fed to the rope drum 3 by way of the deflection element 7. Rough pre-positioning of the rope guide 5 can take place by pivoting the pivoting arm 6 about the pivot axis 48. Precise positioning can take place in particular in the regions close to the flange disc 4, by tilting the deflection element 7.

The pivoting arm 6 in FIG. 2 is pivoted such that the deflection element 7 is situated close to the flange disc 4. The pivot axis 48 of the pivoting arm 6, in terms of the rotation axis 50 of the rope drum 3, is disposed in the centre between the flange discs 4. A central plane M runs perpendicularly to the rotation axis 50. The central plane M contains the pivot axis 48. When the longitudinal axis 49 of the pivoting arm 6 is situated in the central plane M, the pivoting arm 6 is disposed in a central position. The pivoting arm 6 in FIG. 2 is pivoted from the central position by a pivoting angle β.

On its way to the rope drum 3 runs into the rope window 34 in the central plane M. When the pivoting arm 6 is pivoted from a central position, the rope 2 is deflected through the rope window 34. In the embodiments this takes place by virtue of the guide rollers 35.

Figure 3:
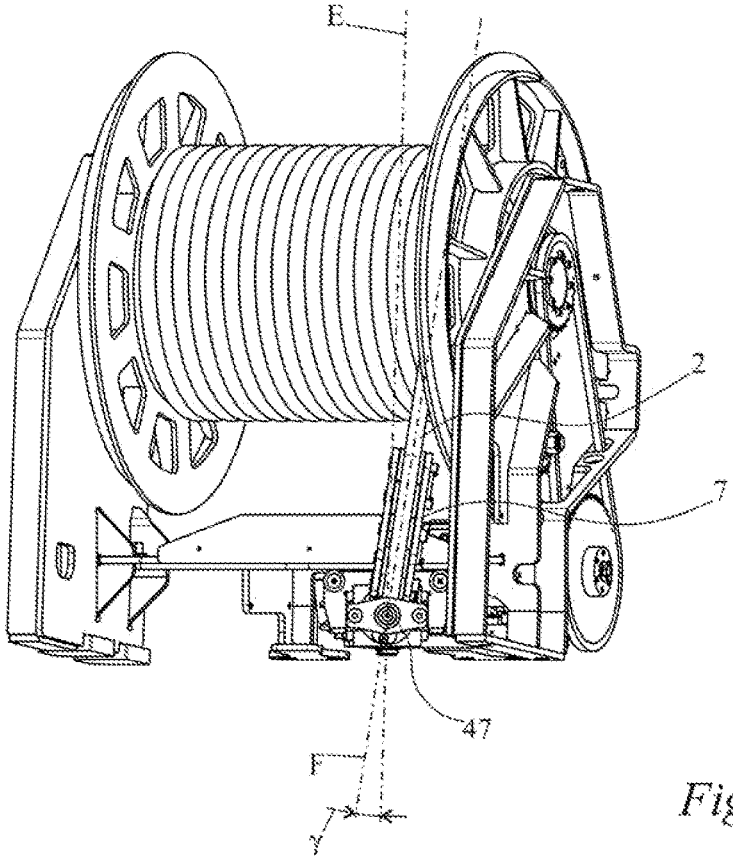
FIG. 3 shows a view in the direction of the arrow III onto the end side of the pivoting arm of the winding device from FIG. 2.
Figure 4:
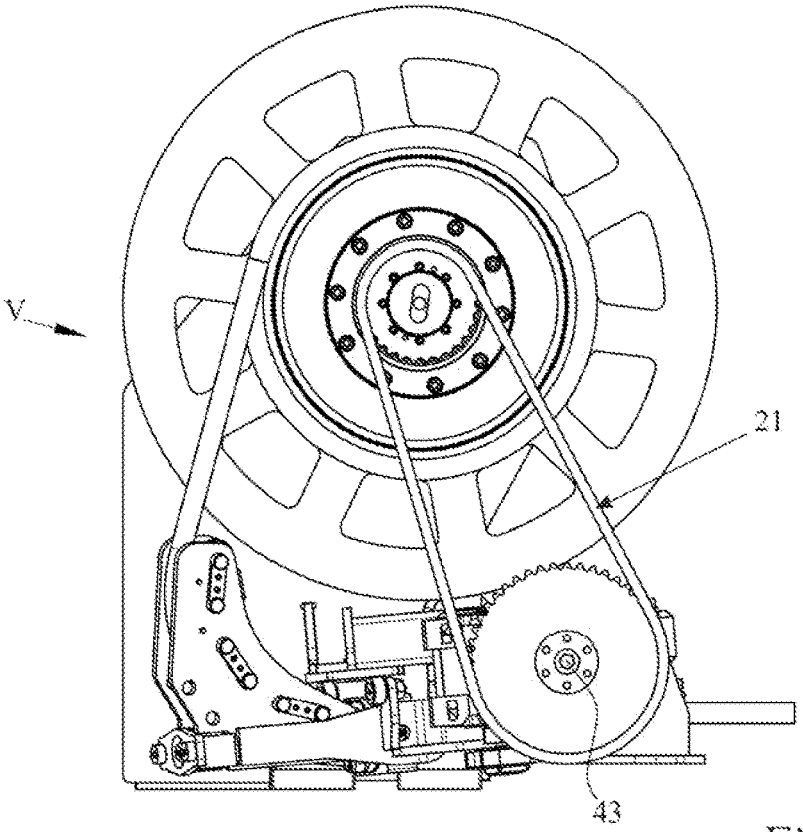
FIG. 4 shows a lateral view of the winding device from FIG. 1, having a disassembled flange disc.
Figure 5:
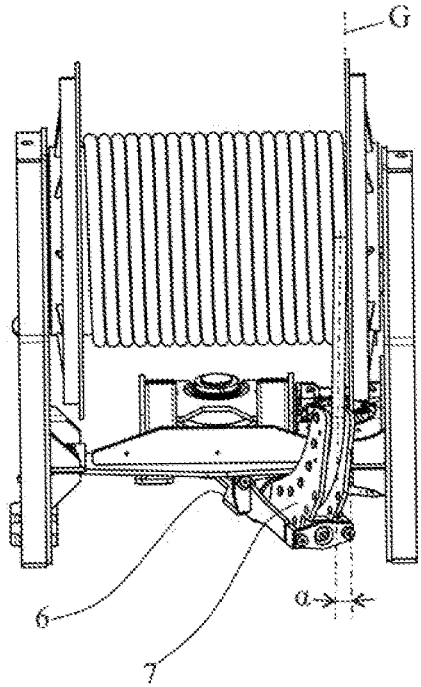
FIG. 5 shows a view in the direction of the arrow V from FIG. 4 onto the winding device from FIG. 4.
Figure 6:
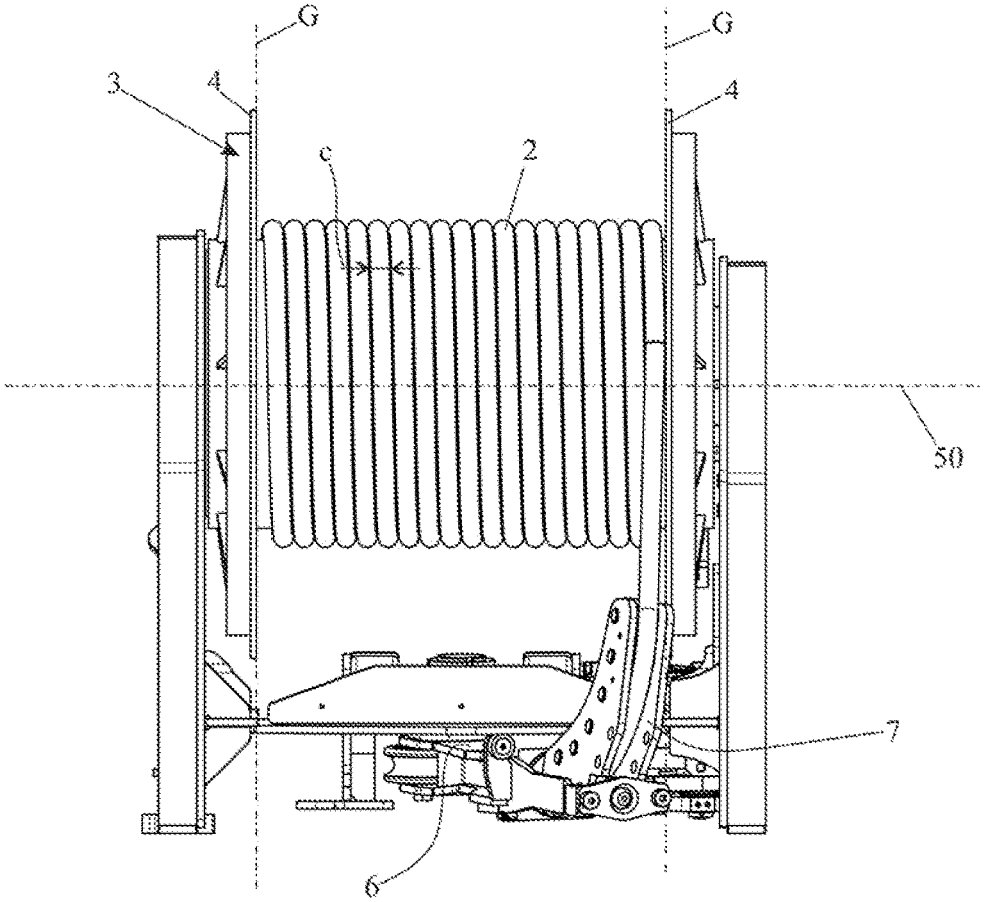
FIG. 6 shows a lateral view of the winding device from FIG. 1 in the direction perpendicular onto the rotation axis of the rope drum and perpendicular onto the pivot axis of the pivoting arm.
Figure 7:
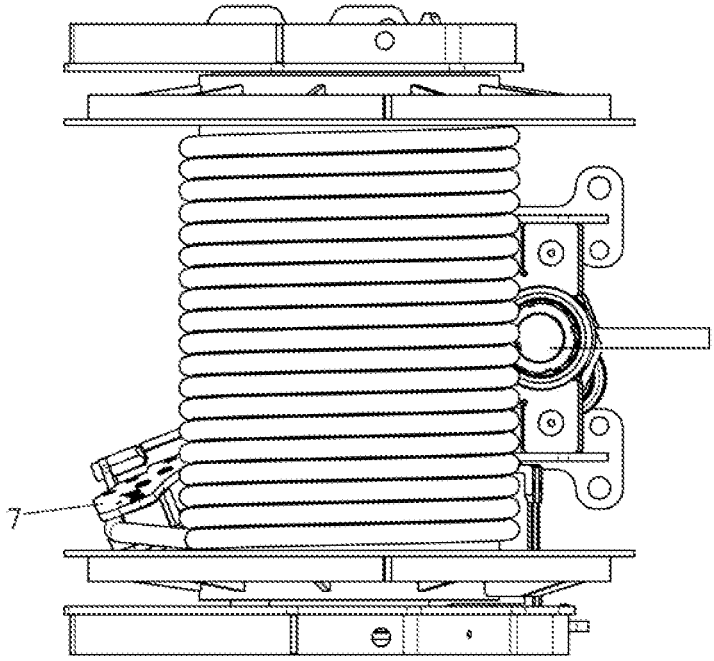
FIG. 7 shows a plan view from above onto the winding device from FIG. 1.

The deflection element 7 in FIGS. 1 to 7 in the position of the pivoting arm 6 in which the latter is pivoted by the pivoting angle β is tilted from a basic position. The deflection element 7 in the basic position guides the rope 2 such that the latter in the region of the deflection element runs in a plane E which contains the pivot axis 48 and the tilting axis 47. FIG. 3 shows a view onto the end side of the deflection element 7, in the direction of the tilting axis 47. The rope 2 in the region of the deflection element 7 is guided in a tilting plane F. The deflection element 7, from the basic position thereof, is tilted out of the plane E into the tilting plane F, to the tilted position of the deflection element 7. The deflection element 7 in FIGS. 2 and 3 is tilted by the tilting angle γ. The tilting plane F in relation to the plane E is tilted by the angle γ about the tilting axis 47. The tilting plane F contains the tilting axis 47. The tilting plane F in relation to the plane E is tilted about the tilting axis 47. This tilting of the deflection element 7 in relation to the pivoting arm 6 is also illustrated in FIGS. 5 to 7.

The deflection element 7 in the embodiment as per FIGS. 1 to 11 is freely movable in relation to the pivoting arm 6. The tilting of the deflection element 7 is caused by the rope 2.

Figure 8:
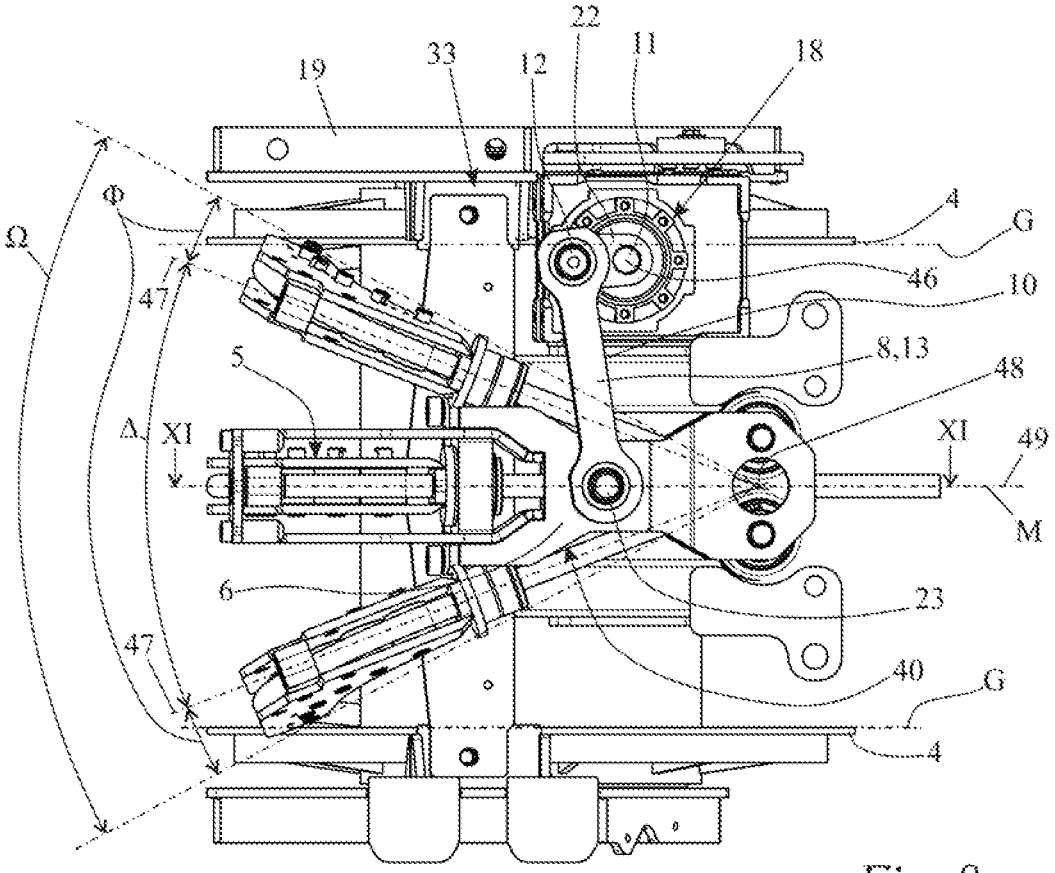
FIG. 8 shows a schematic illustration of the view of the winding device as per FIG. 2, with the illustration of three different positions of the pivoting arm in a single figure.
Figure 9:
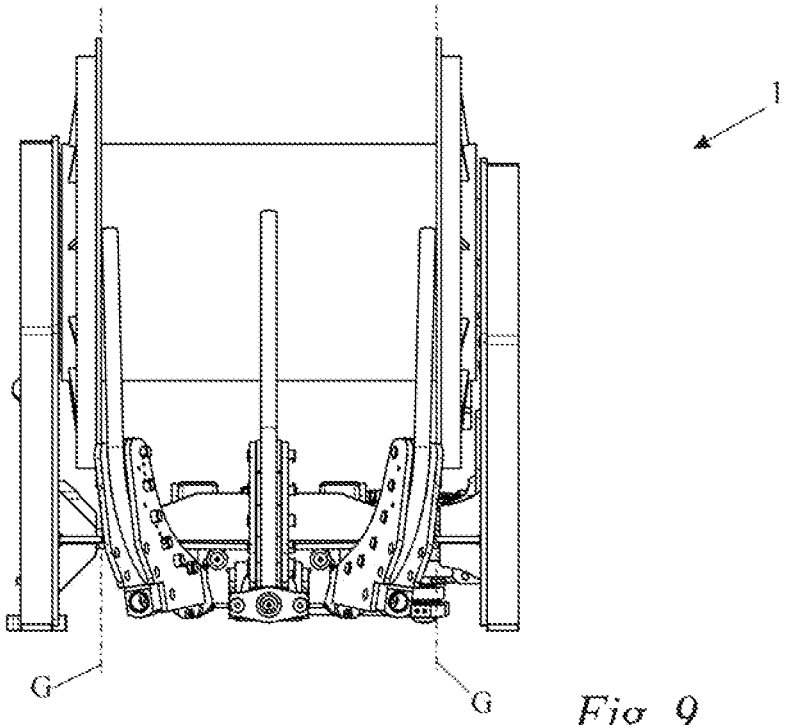
FIG. 9 shows a schematic illustration of the view of the winding device as per FIG. 6, with the illustration of three different positions of the pivoting arm in a single figure.
Figure 10:
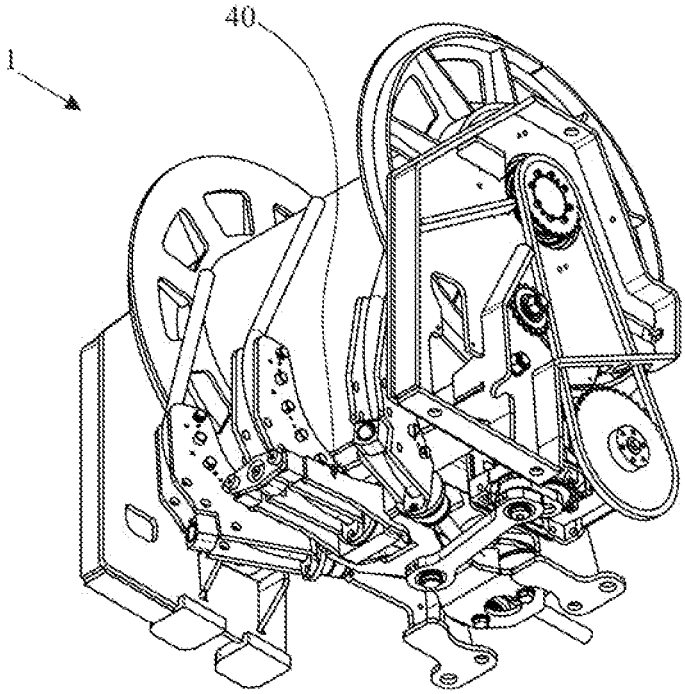
FIG. 10 shows a schematic illustration of the view of the winding device as per FIG. 1, with the illustration of three different positions of the pivoting arm in a single figure.

The schematic illustrations as per FIGS. 8 to 10 show the pivoting arm 6 in the central position. Two further pivoted positions of the single pivoting arm 6, or of the rope guide 5, respectively, are also schematically illustrated. For reasons of improved clarity, the pivoting arm 6 is not plotted in the positions pivoted from the central position.

The two positions of the pivoting arm 6, schematically plotted in FIGS. 8 to 10, are peripheral positions of the pivoting arm 6. The pivoting arm 6 cannot be pivoted any further about the pivot axis 48. The winding device 1 has a delimitation element 8. The delimitation element 8 is disposed such that a pivoting movement of the pivoting arm 6 about the pivoting axis 48 is limited to a critical angular range Δ. The critical angular range Δ extends in a plane perpendicular to the pivot axis 48. The critical angular range Δ is a single contiguous angular range. The critical angular range Δ is at most 135°, in particular at most 90°, preferably at most 70°, in the embodiment at most 60°. The rope guide 5 has a part which in terms of the main body 19 is pivotable about the pivot axis 48. The pivotable part of the rope guide 5 in the embodiments includes the pivoting arm 6 and the deflection element 7. In the absence of the delimitation element 8, the pivotable part of the rope guide 5 would be pivotable between the flange discs 4 in a maximum flange angular range Ω about the pivot axis 48. The flange angular range Ω is limited by the two flange discs 4. The mutually facing insides of the two flange discs 4 each lie in a plane G. The flange angular range Ω is the range in which the pivotable part of the rope guide 5 is pivotable until the pivotable part impacts the mutually opposite planes G of the flange discs 4. When the pivotable part of the rope guide 5 contacts the plane G, a peripheral region of the flange angular range Ω is defined by the position of the tilting axis 47 in this position. The maximum flange angular range Ω is measured in the basic position of the deflection element 7. In the absence of the delimitation element 8, the pivotable part of the rope guide 5 would be pivotable about the pivot axis 48 in a maximum flange angular range Ω between the planes G of the flange discs 4.

The critical angular range Δ is smaller than the flange angular range Ω. The critical angular range Δ is at most 80%, in particular at most 75%, in the embodiment at most 70%, of the maximum flange angular range Ω. The critical angular range Δ lies completely within the flange angular range Ω. Those regions of the flange angular range Ω that are not overlapped by the critical angular range Δ are referred to as angular range ϕ. In the embodiments, the angular range ϕ includes two sub-ranges. The critical angular range Δ in the embodiments is disposed so as to be symmetrical in relation to the central plane M. The maximum flange angular range Ω in the embodiments is disposed so as to be symmetrical in relation to the central plane M. The angular range ϕ in the embodiments is disposed so as to be symmetrical in relation to the central plane M. The winding device 40 is conceived such that the deflection element 7 is tiltable about the tilting axis 47 such that the rope 2 is able to be guided into the angular range ϕ outside the critical angular range Δ by the deflection element 7.

The delimitation element 8 in the embodiments is implemented by a crank mechanism 18. The crank mechanism 18 includes a shaft 11 which is illustrated in FIG. 8. The shaft 11 is rotatable about a shaft axis 46. The shaft 11 in the embodiments, by way of a worm mechanism 20 (FIG. 1), is driven by the motor that drives the rope drum 3. However, it can also be provided that a separate motor is provided for driving the shaft 11. The motor for driving the rope drum 3 is a hydraulic motor. However, this here may also be any other type of motor. The motor drives the rope drum 3. A gearbox, not illustrated, is disposed between the motor and the rope drum 3 in the embodiments. The rope drum 3 is connected to the worm mechanism 20 by way of a chain mechanism 21. A gear wheel of the chain mechanism 21 is connected in a rotationally fixed manner to a worm shaft of the worm mechanism 20. The worm shaft is mounted so as to be rotatable about a worm axis 43 (FIGS. 1 and 4). The worm shaft meshes with a worm wheel which is not illustrated and fixed to the shaft 11. The rope take-up winding device 1 is conceived such that the rope guide 5, in particular the pivoting arm 6 of the rope guide 5, at a specific rotary position of the rope drum 3 in terms of the rotation axis 50, as a function of the rotary position assumes a pivoted position in terms of the pivot axis 48.

The crank mechanism 18 furthermore includes an eccentric 22 (FIG. 8). The eccentric 22 is connected in a rotationally fixed manner to the shaft 11. The eccentric 22, on the longitudinal end of the eccentric 22 that faces away from the shaft axis 46, has a pin 12. The shaft 11 and the eccentric 22 move the pin 12 about the shaft axis 46. The pin 12 is connected in a rotationally fixed manner to the eccentric 22. A connecting rod 13 is rotatably mounted on the pin 12. The connecting rod 13 connects the pin 12 to a bolt 23 of the pivoting arm 6. The connecting rod 13 is pivotably mounted on the bolt 23. The bolt 23 is connected in a rotationally fixed manner to the pivoting arm 6. The bolt 23 is disposed at a spacing d from the pivot axis 48 (FIG. 2). The spacing d of the bolt 23 from the pivot axis 48 is at least 10%, advantageously at least 20%, in the embodiments at least 25% of a pivoting length 1 of the pivotable part of the rope guide 5, the pivoting length 1 proceeding from the pivot axis 48 and being measured perpendicularly to the pivot axis 48. The bolt 23 is disposed on the longitudinal axis 49 of the pivoting arm 6 (FIG. 8). The lengths of the connecting rod 13 and of the eccentric 22 establish in which angular range the bolt 23, and thus also the pivoting arm 6, are pivotable. In this way, the crank mechanism 18 forms the delimitation element 8.

However, it may also be provided that the delimitation element 8 is formed by two simple pins which project from the frame 33 (FIG. 8) and in this way limit the pivoting movement of the pivoting arm 6. In one variant of an embodiment, the winding device can be implemented completely without positive guiding for the pivoting arm or the rope guide. In this instance, the delimitation element limits only the free pivoting movement of the pivotable part of the rope guide.

Figure 15:
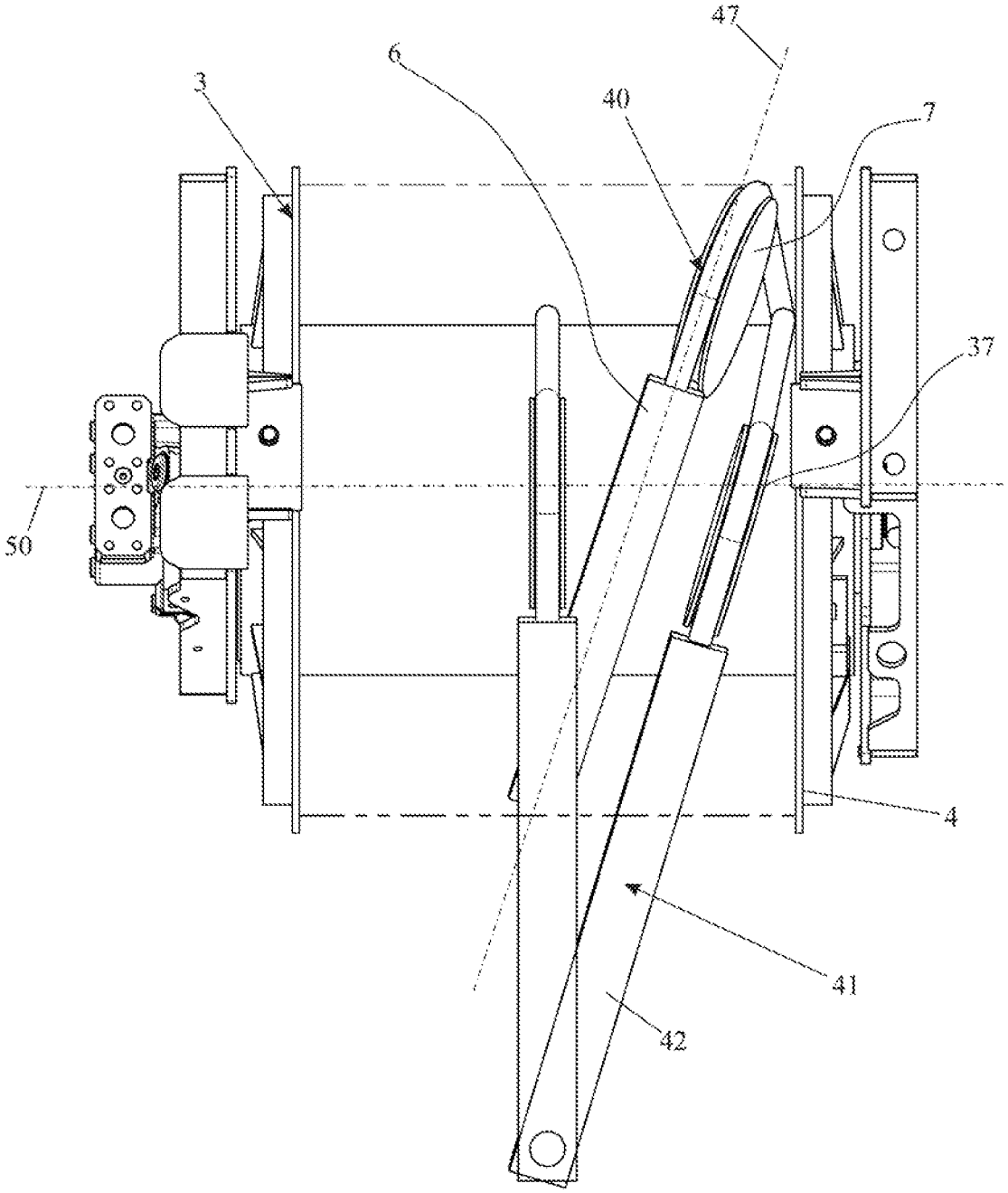

As a result of the pivoting movement of the pivoting arm 6 being limited to the critical angular range Δ and as a result of the tilting capability of the deflection element 7 about the tilting axis 47, the winding device 40 can be of a compact construction and at the same time deliver a positive winding pattern. FIG. 15 shows a comparison between a winding device 40 according to the disclosure and a winding device 41 according to the prior art. The two winding devices 40 and 41 are schematically plotted relative to a single rope drum 3 in a single figure. The winding device 41 has a winding arm 42 with a non-tiltable deflection element 37. The winding arm 42 is illustrated in two different pivoted positions. In the pivoted position of the winding arm 42 close to the flange disc 4, the rope impacts the flange wall. The winding angle is 3°. The wrapping angle about the deflection element 37, configured as a single roller, in this pivoted position is 75°.

The winding device 40 according to the disclosure, likewise illustrated in FIG. 15, likewise has a deflection element 7 configured as a single roller. The diameter of the roller of the winding device 40 in this example corresponds to the diameter of the winding device 41. The pivoting arm 6 in FIG. 15 is in a peripheral position in the peripheral region of the critical angular range Δ. The wrapping angle about the deflection element 7 is likewise 75°. The winding arm 42 of the winding device 41 according to the prior art has a larger spacing from the rotation axis 50 of the rope drum 3 than the pivoting arm 6 of the winding device 40 according to the present disclosure. The deflection element is tilted from the basic position about the tilting axis 47. The rope impacts the flange disc 4. The winding angle is likewise 3°.

The pivoting arm 6 of the winding device 40 according to the disclosure is significantly shorter than the winding arm 42 of the winding device 41 according to the prior art. Nevertheless, the winding device 40 delivers a positive winding pattern and a winding angle of 3°. By virtue of the present disclosure, the winding device 40 can be of a significantly more compact configuration.

The winding device 40 in the embodiments as per FIGS. 1 to 14 has a pivot gear 10. The pivot gear 10 is illustrated in FIG. 2 or FIG. 8, for example. The winding device 40 is conceived such that the pivoting arm 6 via the pivot gear 10 is movable in a reciprocating manner in the critical angular range Δ. The pivot gear 10 in the embodiments includes the crank mechanism 18, the worm mechanism 20 and the chain mechanism 21. An embodiment of the winding device in which the pivot gear includes exclusively the crank mechanism may also be provided. An embodiment of the winding device in which the pivot gear is implemented by another type of returning gearbox may also be provided.

The pivot gear 10 is a component part of a pivot drive. The pivot drive includes a motor. The motor for driving the rope drum 3 in the embodiments is also utilized for driving the pivot gear 10. However, it may also be provided that the pivot drive includes a motor that is configured separately from the motor of the rope drum 3. As a result of the pivot drive 10, the pivoting arm 6 is positively guided. However, it may also be provided that the pivoting arm 6 can move freely in a reciprocating manner in the critical angular range Δ, in particular between the flange discs 4, without a drive. The angular position of the pivoting arm 6 is then this instance determined by the wound position of the rope 2 on the rope drum 3. The pivoting arm 6 follows the rope 2, the latter being wound winding-by-winding in the direction of the rotation axis 50 onto the rope drum 3.

The pivoting arm 6 in the embodiment as per FIGS. 1 to 11 is positively guided, and the deflection element 7 is freely movable in relation to the pivoting arm 6. The tilting of the deflection element 7 is caused by the rope 2. The rope take-up winding device 1 as per FIGS. 1 to 11 is conceived such that the rope 2, when being wound onto the rope drum 3, in the direction of the rotation axis 50 travels a greater distance than the distance which the free end of the pivotable part of the rope guide 5, by virtue of the pivoting about the pivot axis 48, in the same time travels in the direction of the rotation axis 50. The deflecting element 7, on the way thereof from the central plane M illustrated in FIG. 2 to one of the two peripheral regions of the critical angular range Δ, in particular to one of the two flange discs 4, is tilted by the leading rope 2. The degree of tilting of the deflection element 7 in terms of the basic position in the plane E illustrated in FIG. 3 continually increases in the process. The tilting of the deflection element 7 is at the maximum in the reversal point of the pivoting arm 6. The degree of tilting of the deflection element 7 in terms of the basic position in the plane E decreases on the way of the deflection element 7 from the peripheral region of the critical angular range Δ, in particular from the flange disc 4 to the central plane M. When the rope 2 is being unwound from the rope drum 3, the drum of the rope drum 3 rotates about the rotation axis 50 in the opposite direction. The steps described in the context of winding are performed in the reverse order. The deflection element 7 is tilted by the trailing rope 2.

The pivot drive 10 in the embodiments includes the crank mechanism 18 already described. Accordingly, the pivot drive 10 has the shaft 11 that is rotatable about the shaft axis 46, the pin 12 which is disposed eccentrically to the shaft axis 46 and is movable about the shaft axis 46, the eccentric 22, the connecting rod 13 and the bolt 23. The pivoting arm 6 is positively controlled by the pivot gear 10, the latter being a component part of the pivot drive. The pivot gear 10 moves the pivoting arm 6 in a reciprocating manner between the peripheries of the critical angular range Δ illustrated in FIG. 8. The shaft axis 46 in the embodiment runs parallel to the pivot axis 48. In the embodiments as per FIGS. 1 to 13, the eccentric 22 guides the pin 12 on an orbit about the shaft axis 46.

The force of the motor is transmitted to the pivoting arm 6 in particular by way of the gearbox, by way of the rope drum 3, by way of the chain mechanism 21, by way of the worm mechanism 20, and by way of the crank mechanism 18.

The pivot drive is a returning pivot drive. Two tiers of the rope 2 on the rope drum 3 correspond to one revolution of the crank mechanism 18. The pivot gear 10 includes the worm mechanism 20 and the chain mechanism 21. The total gearing of the worm mechanism 20 and of the chain mechanism 21 corresponds to approximately double the number of rope windings on one rope tier. The total gearing in the embodiments corresponds to a reduction gearing of approximately 20 to 50.

The total gearing can be adapted to the number of rope windings on one rope tier. In this way, a drum of the rope drum 3 having a larger or smaller length in terms of the direction of the rotation axis 50 can be used. The adaptation of the total gearing in the embodiments takes place by adapting the gearing of the chain mechanism 21. The gearing ratio of the chain mechanism 21 can be varied between 1:1 and 2.5:1. The rotating speed here is reduced by the chain drive 21.

Figure 14:
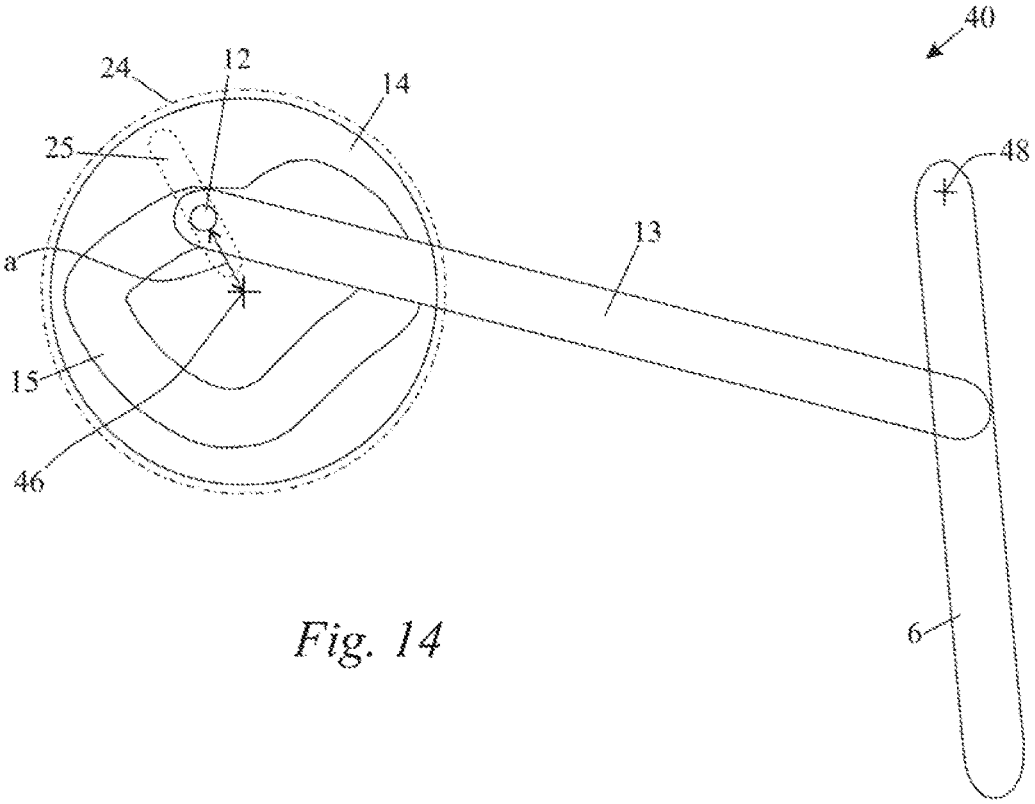
FIG. 14 shows a schematic illustration of an alternative pivot gear for the pivoting arm of a pivoting device as per FIGS. 1 to 13; and, FIG. 15 shows a schematic illustration of a comparison of the winding device according to the disclosure and a winding device from the prior art based on a winding arm having a non-tiltable deflection element.

An alternative embodiment is shown in FIG. 14. The winding device 40 as per FIG. 14 is conceived such that the spacing a between the shaft axis 46 and the pin 12 is varied in the movement of the pin 12 about the shaft axis 46. In the alternative embodiment of the crank mechanism, the crank mechanism instead of the eccentric has a rotating disc 24 and a cam disc 14. The cam disc 14 is fastened in a rotationally fixed manner to the main body 19 of the winding device 40, not illustrated in FIG. 14. The rotating disc 24 is mounted so as to be rotatable in relation to the cam disc 14. The rotating disc 24 is illustrated by dashed lines in FIG. 14. The rotating disc 24 has an elongate bore 25. The elongate bore 25 is an opening which in the direction of the shaft axis 46 completely penetrates the rotating disc 24. The elongate bore 25 has a longitudinal extent. The longitudinal extent of the elongate bore 25 extends in the direction radial to the shaft axis 46. The length of the longitudinal extent of the elongate bore 25 is a multiple of the diameter of the pin 12. The pin 12 is inserted through the elongate bore 25. The shaft 11, not illustrated in FIG. 14, of the pivot gear 10 is connected in a rotationally fixed manner to the rotating disc 24. The rotating disc 24 is likewise rotated in the rotation of the shaft 11. The pin 12 inserted through the elongate bore 25 here is entrained by the periphery of the elongate bore 25. The pin 12 is established on the connecting rod 13.

The cam disc 14 has a track 15. The track 15 is an opening which in the direction of the shaft axis 46 completely penetrates the cam disc 14. The track 15 encircles the shaft axis 46 in a closed manner. The pin 12 is inserted through the track 15 in the direction of the shaft axis 46. The track 15 and the elongate bore 25 overlap when viewed in the direction of the shaft axis 46. The pin 12 in the direction of the shaft axis 46 is inserted through the track 15 as well as through the elongate bore 25. In the rotation of the rotating disc 24 about the shaft axis 46 the pin 12 is entrained by the elongate bore 25 and in the track 15 is guided about the shaft axis 46. The track 15 guides the pin 12 on the path thereof about the shaft axis 46. The spacing a of the pin 12 from the shaft axis 46 is varied in the process. The track 15 is configured such that the track 15 causes the variation of the spacing a of the pin 12.

The spacing a as a function of the angular position of the rotating disc 24 is varied by the track 15 such that a constant rope pitch results when the rope is being wound on the rope drum 3. The rope take-up winding device 1 is conceived such that the pivoting arm 6 in a rotation of the rope drum 3 about the rotation axis 50 is offset in the direction of the rotation axis 50 of the rope drum 3 by 100% to 110% of the rope diameter c of the rope 2 illustrated in FIG. 6, in particular by 100% to 105% of the rope diameter c, in the embodiment by 100% to 102% of the rope diameter c. This applies in particular when the alternative crank mechanism is used in the winding device 40 as per FIGS. 12 and 13. The crank mechanism as per FIG. 14 can also be used in the embodiments as per FIGS. 1 to 13.

Irrespective of the specific embodiment of the crank mechanism, the pivotable part of the rope guide 5 in the embodiments as per FIGS. 1 to 13 is pivotable about the pivot axis 48. As mentioned, an embodiment in which the pivotable part of the rope guide 5 is not positively controlled but freely pivotable is also conceivable. As is illustrated in FIG. 2, the pivotable part of the rope guide 5 has a pivoting length l which is measured, proceeding from the pivot axis 48, perpendicularly to the pivot axis 48. The flange discs 4 each have a largest diameter measured perpendicularly to the rotation axis 50. The larger of these two diameters is referred to as the maximum diameter d. The pivoting length l of the pivotable part of the rope guide 5 is at most 100%, in particular at most 95%, in the embodiment at most 90%, of the maximum diameter d.

Figure 11:
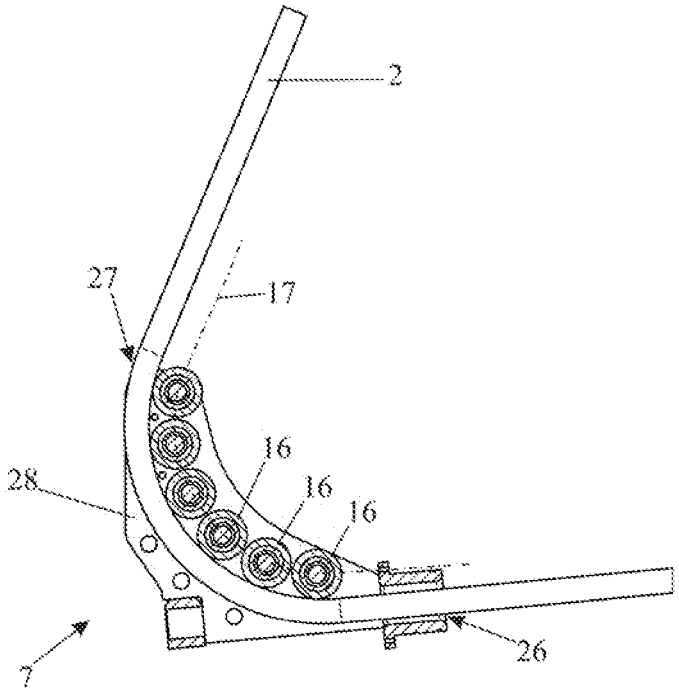
FIG. 11 shows a sectional illustration of a section along the section plane XI-XI from FIG. 8 through the deflection element.

FIG. 11 shows the deflection element 7. The deflection element 7 has a rope entry 26. The rope 2 is fed to the deflection element 7 through the rope entry 26. The deflection element 7 has a rope exit 27. The rope 2 exits the deflection element 7 at the rope exit 27. The rope 2 is deflected in the deflection element 7.

Only a single deflection roller is typically used to this end in the prior art. In a deflection of the rope of approximately 90°, a wrapping angle of the single roller of approximately 90° is also required in this instance. Should the radius of the single roller be chosen to be too small, this can result in excessive and rapid wear of the rope. In contrast, a large radius of the single deflection roller requires a large installation space and prevents the single deflection roller from being able to be disposed at the desired small radial spacing from the rope drum.

A plurality of rollers 16 are provided in the deflection element 7 as per the embodiments. The rollers 16 are disposed on a cam track 17. The rollers 16 are mounted so as to be rotatable on a basic member 28 of the deflection element 7. The rollers 16 are disposed so as to be directly next to one another on the cam track 17. The wrapping angle of the rope 2 about a single one of the plurality of rollers 16 is in each case less than 30°, in particular less than 20°, in the embodiment less than 10°. Six rollers 16 are provided in the embodiment. The cam track 17 can reproduce a circle. The curvature of the cam track 17 in the embodiment is greater than that of a circle through the rotation axes of the two outermost rollers, the central axis of the circle running parallel to the rotation axes. The mutual spacing of the individual rollers 16 is less than 100%, in particular less than 50%, in the embodiment less than 5%, of the diameter of the smallest roller 16. The diameters of the rollers 16 are identical in the embodiment. The rope 2 in the deflection element 7 is guided on the deflection rollers 16 from the rope entry 26 to the rope exit 27. The basic member 28 on both sides of the rope 2 delimits a guiding space for the rope 2 in the direction of the rotation axes of the rollers 16.

Figure 12:
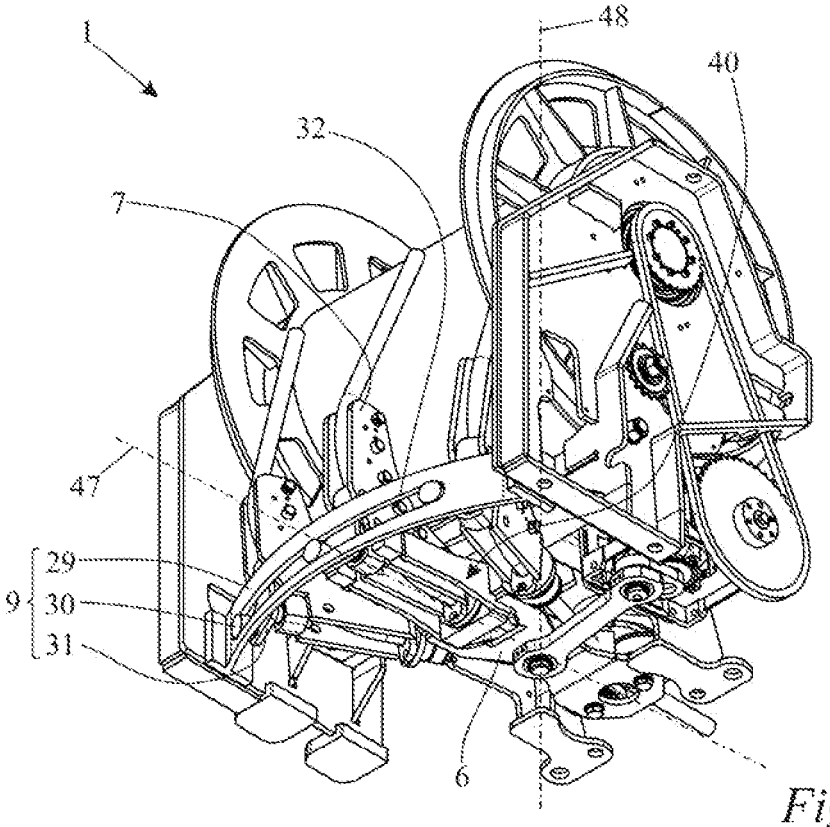
FIG. 12 shows a schematic perspective illustration of an alternative embodiment of a winding device having an actuator for setting the tilted position of the deflection element as a function of the pivoted position of the pivoting arm, wherein three different pivoted positions of the pivoting arm are illustrated in a single figure.
Figure 13:
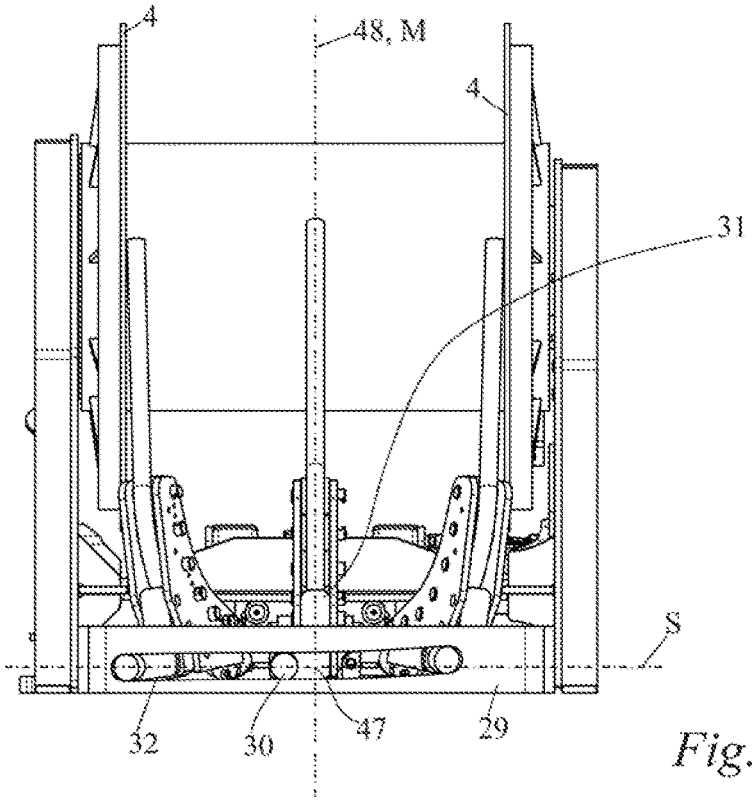
FIG. 13 shows a schematic illustration of a lateral view of the winding device as per FIG. 12, with the illustration of three different positions of the pivoting arm in a single figure.

FIGS. 12 and 13 show an alternative embodiment of the winding device 40, or of the rope take-up winding device 1. The winding device 40 as per FIGS. 12 and 13 differs from the winding device as per FIGS. 1 to 11 only in that an actuation means 9 is additionally provided. The other components of the winding device 40 as per FIGS. 12 and 13 are embodied so as to be identical to the components of the winding device 40 as per FIGS. 1 to 11. Accordingly, identical reference signs are also used.

The deflection element 7 in terms of the tilting axis 47 is disposed in a tilted position. The pivoting arm 6 in terms of the pivot axis 48 is disposed in a pivoted position. The winding device 40 as per FIGS. 12 and 13 is conceived such that the actuator 9 predefines the tilted position of the deflection element 7 as a function of the pivoted position of the pivoting arm 6. The actuator 9 in the embodiment as per FIG. 12 includes a guide slot 29, a guide slot pin 30 and a tilting element 31. The tilting element 31 is connected in a rotationally fixed manner to the tiltable deflection element 7. The guide slot pin 30 is established on the tilting element 31. The guide slot pin 31 in the direction of the tilting axis 47 projects beyond the tilting element 31. The guide slot pin 30 is disposed eccentrically to the tilting axis 47. The guide slot pin 30 has a spacing from the tilting axis 47 that is measured in the direction of the rotation axis 50. The guide slot pin 30 has a spacing from the deflection element 7 that is measured in the direction of the rotation axis 50. The guide slot pin 30 is inserted through a guide slot track 32 of the guide slot 29. The guide slot track 32 is an opening in the guide slot 29 that completely penetrates the guide slot 29 in the direction of the tilting axis 47.

As is illustrated in FIG. 13, the tilting axis 47 in a pivoting plane S is pivotable about a pivot axis 48. The pivoting plane S is perpendicular to the pivot axis 48. When the deflection element 7 is situated in the central plane M between the flange discs 4, the guide slot pin 30 by way of the central axis thereof is disposed in the pivoting plane S. The guide slot track 32 runs obliquely to the pivoting plane S. When the deflection element 7 is pivoted from the central plane M, the guide slot pin 30, in particular the central axis of the guide slot pin 30, by virtue of the guide slot pin 30 being guided in the guide slot track 32 of the guide slot 29, is moved out of the pivoting plane S. Since the guide slot pin 30 is fastened on the tilting element 31 so as to be eccentric to the tilting axis 47, the tilting element 31 is tilted when the guide slot pin 30 is deflected from the pivoting plane S. When the pivoting arm 6 is being pivoted about the pivot axis 48, from the central plane M towards one of the two peripheral regions of the critical angular range Δ, in particular towards one of the two flange discs 4, the deflection element 7 is continuously tilted ever more about the tilting axis 47. The guide slot track 32 has a continuous profile. However, a guide slot track which has a discontinuous profile and causes an abrupt change in the tilted position of the deflection element 7 may also be provided.

The actuator 9 causes a dependency of the tilted position of the deflection element 7 on the pivoted position of the pivoting arm 6. The actuator can also be implemented in any other conceivable manner. For example, a separate drive, which by way of a control unit is tuned to the pivot drive, can be provided for tilting the deflection element 7. It is likewise conceivable that the tilted position of the deflection element 7 is implemented by a gearbox connection to the pivot drive. The positive control of the tilting of the deflection element 7 can also be implemented by way of a thrust member, for example, which is mounted so as to be tiltable about an axis which extends parallel to the line of intersection of the central plane M illustrated in FIG. 13 and of the pivoting plane S. A point at the base of the deflection element here may move only in a plane parallel to the pivoting plane S illustrated in FIG. 13. The length of the thrust member changes when the thrust member is pivoted. The deflection element 7 is pivoted about the pivot axis of the thrust member to the same degree as the thrust member.

It is understood that the foregoing description is that of the preferred embodiments of the invention and that various changes and modifications may be made thereto without departing from the spirit and scope of the invention as defined in the appended claims.

What is claimed is:

1. A winding device for winding a rope onto a rope drum which is rotatable about a rotation axis, comprising:

a rope guide for feeding the rope to the rope drum;

said rope guide having a pivoting arm defining a longitudinal axis and further having a deflection element;

said pivoting arm being pivotable about a pivot axis;

said deflection element being disposed on said pivoting arm;

wherein the winding device is configured such that the rope when being wound onto the rope drum passes said pivoting arm before said deflection element;

wherein a pivoting movement of said pivoting arm about the pivot axis is limited to a critical angular range Δ;

said deflection element being tiltable about a tilting axis extending along the longitudinal axis of said pivoting arm; and, wherein said deflection element is tiltable about the tilting axis such that the rope is able to be guided by said deflection element in an angular range ϕ outside the critical angular range Δ.

2. The winding device of claim 1 further comprising:

an actuator;

said deflection element being disposed in a tilted position in terms of the tilting axis;

said pivoting arm being disposed in a pivoted position in terms of the pivot axis; and, wherein said actuator predefines said tilted position as a function of said pivoted position.

3. The winding device of claim 1, wherein said rope guide has a pivot gear for driving by a motor; and, said pivoting arm, via said pivot gear, is movable in a reciprocating manner in said critical angular range Δ.

4. The winding device of claim 3, wherein:

said pivot gear has a shaft, a pin, and a connecting rod;

said shaft is rotatable about a shaft axis;

said pin is disposed eccentrically to the shaft axis and is movable about the shaft axis;

said connecting rod connects said pin to said pivoting arm; and, said pivot gear is configured such that a spacing between the shaft axis and the pin varies in a movement of said pin about said shaft axis.

5. The winding device of claim 4, wherein said spacing between said shaft axis and said pin in the movement of said pin about said shaft axis is varied such that a constant rope pitch is achieved when the rope is being wound on the rope drum.

6. The winding device of claim 4, wherein said pivot gear has a cam with a track in which said pin is guided on a path of said pin about said shaft axis.

7. The winding device of claim 1, wherein said deflection element includes a plurality of rollers which are mutually adjacently disposed on a cam track.

8. A rope take-up winding device comprising:

a rope drum having two flange discs;

a winding device for winding a rope onto said rope drum;

said rope drum being rotatable about a rotation axis;

said winding device including a rope guide for feeding the rope to said rope drum;

said rope guide having a pivoting arm defining a longitudinal axis and further having a deflection element;

said pivoting arm being pivotable about a pivot axis;

said deflection element being disposed on said pivoting arm;

said winding device being configured such that the rope when being wound onto said rope drum passes said pivoting arm before said deflection element;

wherein a pivoting movement of said pivoting arm about said pivot axis is limited to a critical angular range Δ;

said deflection element being tiltable about a tilting axis extending along said longitudinal axis of said pivoting arm;

wherein said deflection element is tiltable about the tilting axis such that the rope is able to be guided by said deflection element in an angular range ϕ outside the critical angular range Δ; and, said pivoting arm being pivotable about said pivot axis so as to reciprocate between said two flange discs.

9. The rope take-up winding device of claim 8, wherein a pivotable part of said rope guide that is pivotable about said pivot axis in an absence of a delimitation of the pivoting movement of said pivoting arm about the pivot axis to the critical angular range Δ would be pivotable between said two flange discs in a maximum flange angular range Ω; and, said critical angular range Δ is at most 80% of said maximum flange angular range Ω.

10. The rope take-up winding device of claim 8, wherein a pivotable part of said rope guide that is pivotable about said pivot axis an absence of a delimitation of the pivoting movement of said pivoting arm about the pivot axis to the critical angular range Δ would be pivotable between said two flange discs in a maximum flange angular range Ω; and, said critical angular range Δ is at most 70% of said maximum flange angular range Ω.

11. The rope take-up winding device of claim 8, wherein a pivotable part of said rope guide, proceeding from said pivot axis, has a pivoting length measured perpendicularly to said pivot axis; said two flange discs have a maximum diameter; and, said pivoting length is at most 100% of said maximum diameter.

12. The rope take-up winding device of claim 8, wherein a pivotable part of said rope guide, proceeding from said pivot axis, has a pivoting length measured perpendicularly to said pivot axis; said two flange discs have a maximum diameter; and, said pivoting length is at most 90% of said maximum diameter.

13. The rope take-up winding device of claim 8, wherein said rope guide at a specific rotary position of said rope drum in terms of said rotation axis, as a function of the specific rotary position, assumes a pivoted position in terms of said pivot axis.

14. The rope take-up winding device of claim 8, wherein said pivoting arm at a specific rotary position of said rope drum in terms of said rotation axis, as a function of the specific rotary position, assumes a pivoted position in terms of said pivot axis.

15. The rope take-up winding device of claim 8 further comprising a drum drive for driving the rope drum.

16. The rope take-up winding device of claim 8, wherein said rope drum is a component part of a drum winch; and, all tensile forces are transmitted from the rope to said rope drum.

17. The rope take-up winding device of claim 8, wherein said rope drum is a component part of a storage drum; and, the rope take-up winding device is configured such that only pretension forces are transmitted from the rope to said rope drum.

* * * * *